United States Patent [19]

Levine et al.

[11] 3,981,138

[45] Sept. 21, 1976

[54] DIGITAL DISPLAY TIMEPIECE

[75] Inventors: Morris M. Levine, Scarsdale; Arthur F. Cake, Smithtown, both of N.Y.

[73] Assignee: Uranus Electronics, Inc., Port Chester, N.Y.

[22] Filed: Dec. 2, 1974

[21] Appl. No.: 528,798

Related U.S. Application Data

[62] Division of Ser. No. 365,570, May 31, 1973, abandoned.

[52] U.S. Cl. ..... 58/23 R; 58/50 R; 58/88 R

[51] Int. Cl.[2] ..... G04C 3/00

[58] Field of Search ..... 58/23 R, 23 A, 23 AC, 58/50 R, 88 R, 88 C

[56] References Cited

UNITED STATES PATENTS

| | | | |
|---|---|---|---|
| 3,733,803 | 5/1973 | Hiraga et al. | 58/23 R |
| 3,747,327 | 7/1973 | Uchiyama | 58/23 R |
| 3,759,031 | 9/1973 | McCullough et al. | 58/50 R |
| 3,783,607 | 1/1974 | Fearer | 58/50 R X |
| 3,838,568 | 10/1974 | Zurcher et al. | 58/23 R X |
| 3,846,971 | 11/1974 | Ho et al. | 58/23 R |
| 3,861,135 | 1/1975 | Seeger et al. | 58/50 R |

*Primary Examiner*—Lawrence R. Franklin
*Attorney, Agent, or Firm*—Bauer, Amer & King

[57] ABSTRACT

An electronic timepiece employs a single printed circuit board on an insulator base structure having contacts aligned with push buttons extending through the case for actuating electronic circuitry carried by the printed circuit and a cover supported by pins over the printed circuit. The cover has an opening exposing only the digital display.

6 Claims, 6 Drawing Figures

FIG. 1
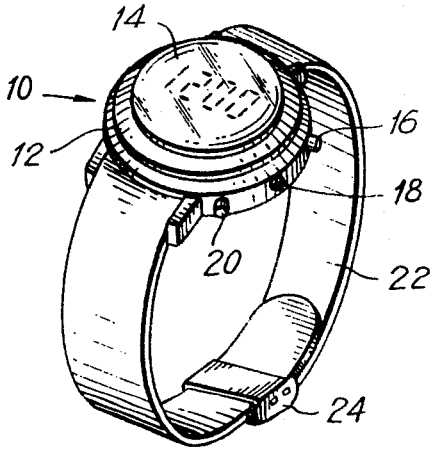
FIG. 2
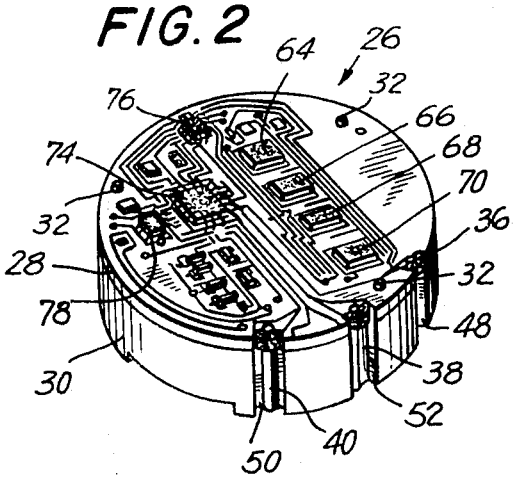
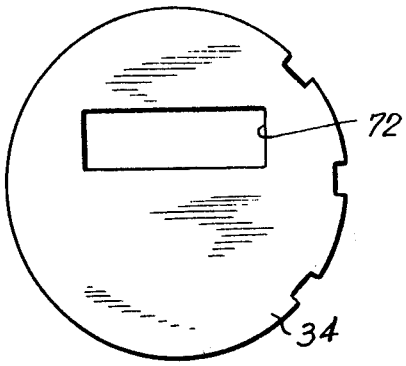
FIG. 6
FIG. 4
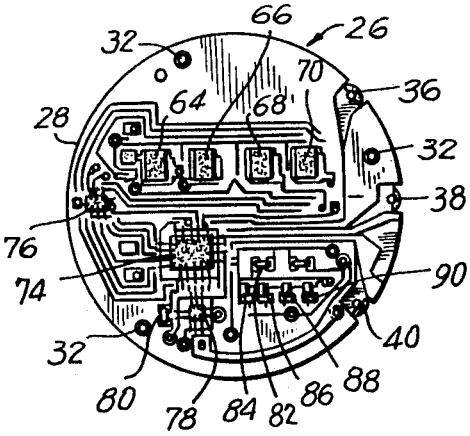
FIG. 5
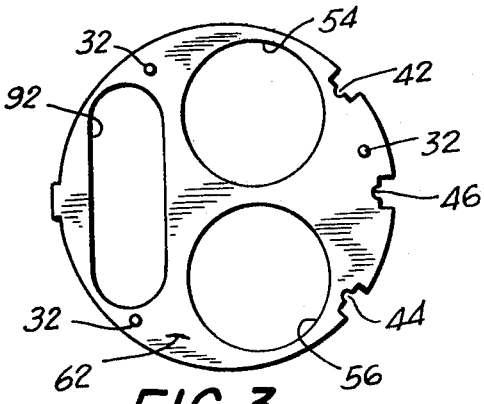
FIG. 3
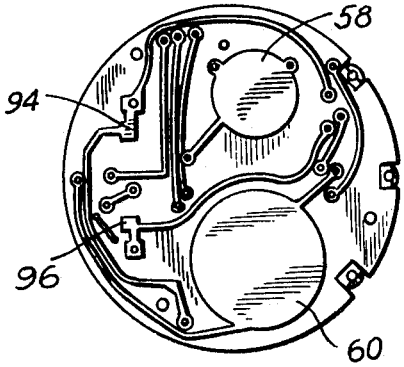

DIGITAL DISPLAY TIMEPIECE

This is a division of application Ser. No. 365,570, filed May 31, 1973, now abandoned.

BACKGROUND

Electronic timepieces with electro-optical display means such as liquid crystals and light emitting diodes have recently found acceptance as a reasonable alternative to electro-mechanical time-pieces. As is outlined by our copending patent application Ser. No. 235,608 filed on Mar. 17, 1972, the development of CMOS technology has made these designs feasible, and advances set forth by our copending patent applications has by reducing current drain made such designs practical.

Further attempts at making such timepieces, as are addressed by this patent application, as well as by our copending patent application, more practical have been noted in U.S. Pat. Nos. 3,576,099 and 3,672,155 directed to, among other things, providing command means for effecting display of time information for a limited duration to further conserve power drain.

In all developments noted so far it has been thought necessary to use ceramic boards for mounting the electronics. This has been reported to be necessary for reliability and strength to enable assembly of the circuitry.

OBJECTS

The primary object of the present invention is to accomplish a reliable packaging of the electronic means in a more economical and practical manner than heretofore thought possible by using a single printed circuit board backed by a plastic base for mounting the electronics, the electro-optical display, the crystal, the batteries and the contacts for the switch means commanding and programming the display and logic means, respectively, that are located about the periphery of the casing for all of the above.

More particularly, a principal object of this invention is to utilize a plurality of switches of push button type along the side of the casing such that direct pressure through the casing is lateral rather than vertical in command and programming. This has a principal advantage over designs such as shown by U.S. Pat. No. 3,672,155 in that no pressure need be applied to the wrist of the wearer of the timepiece in operation of the command or programming switch buttons.

Another principal object of this invention is to utilize the ability of a printed circuit board to increase the complexity of electronics possible in a compact arrangement.

A still further object of this invention is to utilize a plastic base to provide accommodation of bulky parts and strength for the printed circuit board to facilitate bonding of wire leads between the electronics and circuitry on the board to integrate the required circuits, and, in addition, mount contacts to be located in a desired spatial relationship for ease of assembly aligned with switch means carried by the casing of the timepiece.

Still another object of this invention is to utilize a plurality of switch means at least one for command of a digital display and another for programming the logic of the electronics to set the display means in accordance with a known time standard with the switch for programming being accessible from the side of the casing and flush or slightly recessed to prevent inadvertant operation.

Still another and more particular object of this invention is to provide switch means for command of the digital display arranged to be operable by the forefinger of the person wearing the timepiece by pressure laterally across the casing that may be balanced by thumb pressure on the opposite side of the casing.

Another detailed object of this invention is to provide an assembly of printed circuit board and plastic base by locating pins projecting a limited distance above the board for mounting of a windowed cover over the electronics to eliminate ambient light from affecting the electronics through a viewing window of the casing thereover.

DRAWING DESCRIPTION

Other and more particular objects will appear from the following description of the drawings in which:

FIG. 1 is a perspective view of a wristwatch constructed in accordance with this invention;

FIG. 2 is a perspective enlarged view of the electronic means including display means mounted on a printed circuit board over a plastic base;

FIG. 3 is a top view of the plastic base prior to assembly of the printed circuit board thereon;

FIG. 4 is a top view of the printed circuit board with electronic means bonded thereon prior to bonding to the plastic base and bonding of wire leads to integrate the circuit;

FIG. 5 is a bottom view of the printed circuit board showing the surface bonded to the plastic base; and FIG. 6 is a top view of a cover for assembly over the printed circuit board to rest on the locating pins projecting therethrough from the plastic base.

DETAILED DESCRIPTION

With more particular regard to FIG. 1 there is shown an electronic watch 10 having a casing 12 with a window 14 through which is displayed the time of twelve o'clock. On the right side of the casing 12 are three push buttons 16, 18 and 20, two of which, 16 and 20, project from the casing and the other of which, 18, is flush with the side of the casing. The wristwatch is provided with a band 22 and a clasp 24 for affixing it to the wrist of a wearer thereof.

With reference now to FIG. 2 there is shown an electronic timing assembly 26 comprising a printed circuit board 28 mounted to a plastic base 30 and located thereon by three pins 32 projecting from base 30 through board 28. The projecting pins 32 serve as a preventive spacer for a cover 34 shown by FIG. 6 placed over the assembly 26 prior to insertion thereof into casing 12. Prior to assembly of the board 28 to base 30, three contact pins 36, 38 and 40 are snap fitted into slots 42, 44 and 46 machined into recessed areas 48, 50 and 52 of base 30. These pins are located to be adjacent to the inner ends of push buttons 16, 18 and 20 and thereby serve as contacts to certain of the electronics of the printed circuit board for supplying battery power from batteries (not shown) in series arrangement in cavities 54 and 56 of base 30 accessible from the rear of the casing, as those skilled in the art appreciate. More particularly, the batteries are connected to the board by battery plates 58 and 60 (See FIG. 5) on the side of the board adjacent and bonded to the base 30 located above the cavities 54 and 56 on surface 62 (See FIG. 3). Without regard to all the electronics on the board 28, the buttons 16, 18 and 20 are adapted to complete the circuit to the display means 64, 66, 68 and 70, shown in the form illustrated as light emitting diodes, to generate the display of 12 o'clock shown by FIG. 1. The display is viewed through opening 72 in the cover 34 via the window 14. Suffice it to say for the purposes of this disclosure that the printed circuit board has bonded thereto on its top side, in addition to diodes 64, 66, 68 and 70, a large scale integrated chip 74, a segment driver chip 76, a digit driver chip 78, resistor chips 80 and 82 and capacitor chips 84, 86, 88 and 90. The board 28 has formed thereon a plurality of leads adapted to be connected to appropriate pads of each of the chips by wire leads bonded to pads on the chips and appropriate leads on the printed circuit board. A crystal (not shown) is located in the cavity 92 and connected to the printed circuit board 28 by contacts 94 and 96. The leads on the board 28 connect the batteries to appropriate chip means via a select number of capacitors to provide the desired frequency signal for counting according to the logic of the large scale integrated chip which is always available at the digit driver and segment driver to be reproduced by the diodes when called forth by either buttons 16 or 20. Button 18 on the other hand is operable to program the chip 74 to set the display in accordance with known factors such as the correct time and date.

When the cover 34 is placed over the assembly 26 to rest on the edge of P.C. Board it not only provides protective space for wire leads, but prevents light from affecting any of the chips which could tend to cause a malfunction. Also the cover 34 would serve as a protection for the entire assembly 26 in the event of a break in the window 14. The cover is normally spaced from the top of pins 32, and, if pressed down on assembly 26 too hard, the pins will prevent contact between the cover and the electronics and wires thereunder.

To understand the operation of the electronics connected by the printed circuit board reference should be made to our copending application set forth above.

The foregoing embodiment is illustrative but not restrictive, and the scope of this invention is more adequately indicated by the appended claims for all structure within the range and equivalency of the terms thereof.

We claim:

1. An electronic timepiece comprising:

a casing having a plurality of push buttons on the sides thereof with at least one projecting from the side of the casing laterally in the plane of the casing and another terminating in a head substantially flush with a peripheral side surface of the casing, said casing having a window closing the top thereof;

digital time display means under said window controllable by said push buttons;

electronic timing assembly means within said casing, said electronic timing assembly means including a logic means and a digit driver means affixed to a single printed circuit board means on an insulate base structure, said base structure supporting contacts along the side thereof aligned with said push buttons for completing a circuit from said logic means to said digit driver means to actuate said digital display means, said printed circuit board means having openings receiving locator pins of said insulate base structure, which locator pins extend upwardly above said printed circuit board means; and a cover over said electronic timing assembly means under said window having an opening exposing only said digital time display means to the window of said casing, said locating pins preventing said cover from contacting said logic means.

2. The structure of claim 1 wherein said plastic base has means to hold contact pins on the sides thereof aligned with the push buttons, said contact pins being electrically connected to printed circuit board circuitry.

3. The structure of claim 2 wherein the contact pins number three at least and the push buttons are of equal number.

4. The structure of claim 1 and further characterized in that said plastic base is provided with cavities leading to circuitry of said printed circuit board thereabove for mounting within the dimension of said base a frequency generating means and a power supply whereby a compact package is provided for said casing.

5. The structure of claim 4 wherein said plastic base has means to hold contact pins on the sides thereof aligned with the push buttons, said contact pins being electrically connected to printed circuit board circuitry.

6. The structure of claim 5 wherein the contact pins number three and the push buttons are of equal number.

* * * * *

UNITED STATES PATENT OFFICE

CERTIFICATE OF CORRECTION

PATENT NO. : 3,981,138

DATED : September 21, 1976

INVENTOR(S) : MORRIS M. LEVINE & ARTHUR F. CAKE

It is certified that error appears in the above-identified patent and that said Letters Patent are hereby corrected as shown below:

Column 4, line 18, after "digital" insert --time--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*